United States Patent [19]

Ewald

[11] 4,085,533

[45] Apr. 25, 1978

[54] DEVICE FOR PRODUCING AESTHETIC EFFECTS

[76] Inventor: Alfred Ewald, 62 Wiesbaden Nerotal 3, Germany

[21] Appl. No.: 634,642

[22] Filed: Nov. 24, 1975

[30] Foreign Application Priority Data

Nov. 25, 1974 Germany ..... 2455638

[51] Int. Cl.[2] ..... G09F 13/24

[52] U.S. Cl. ..... 40/406; 40/427

[58] Field of Search ..... 40/106.21; 272/8, 46, 272/41; 35/19 R; 350/3.5, 4, 5

[56] References Cited

U.S. PATENT DOCUMENTS

| | | | |
|---|---|---|---|
| 2,453,178 | 11/1948 | Abramson | 40/106.21 |
| 3,392,466 | 7/1968 | Lo Giudice | 40/106.21 |
| 3,564,740 | 2/1971 | Calfee | 40/106.21 |
| 3,570,156 | 3/1971 | Walker | 40/106.21 |
| 3,613,264 | 10/1971 | Vitka et al. | 40/106.21 |
| 3,629,958 | 12/1971 | Olson | 35/19 R |
| 3,703,332 | 11/1972 | Taylor | 40/106.21 |
| 3,964,194 | 6/1976 | Gugeler | 40/106.21 |

*Primary Examiner*—Robert W. Michell
*Assistant Examiner*—V. Millin
*Attorney, Agent, or Firm*—Gifford, Chandler, Sheridan & Sprinkle

[57] ABSTRACT

The specification describes a device for producing aesthetic effects, more particularly light effects, with at least one partly transparent or transluscent and preferably closed vessel. The vessel contains at least two liquids of different density which are not completely and not permanently miscible with each other. In the order of increasing density at least three liquids A, B, C with the following principal or sole components are employed:

A liquid paraffin and/or silicone oil and/or naphthene and/or hexachlorobutadiene;

B water or an ether, more particularly propanetrioxyethylether or a polyether;

C esters with chemically bound phosphorus and/or chemically bound halogen, preferably chlorine, an ester of phthalic acid, and more particularly dibutoxybutyl phthalate, a carbonic acid ester, more particularly propanediol carbonate, or ethanediolmonophenylether or tetrahydrothiophene-1,1-dioxide with the provision that the selected liquids are not completely and not permanently miscible with each other.

39 Claims, 22 Drawing Figures

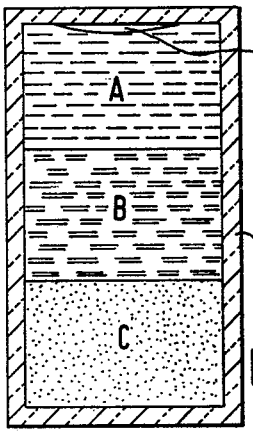
FIG.1
FIG.2
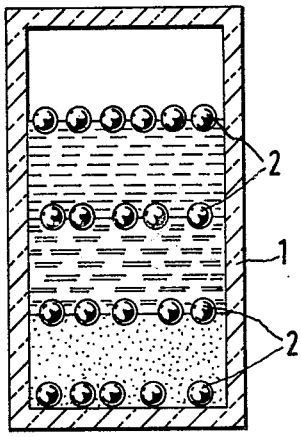
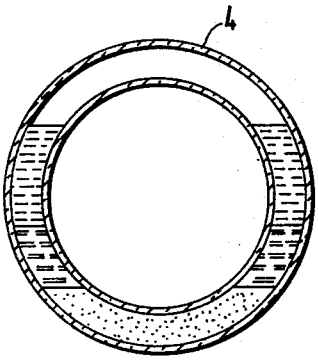
FIG.3
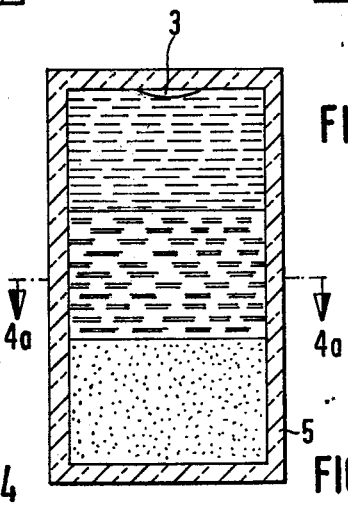
FIG.4
FIG.4a
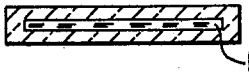
FIG.5
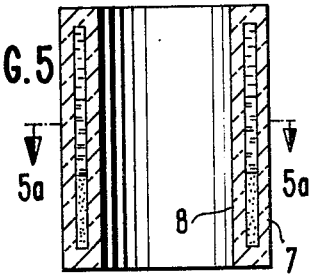
FIG.5a
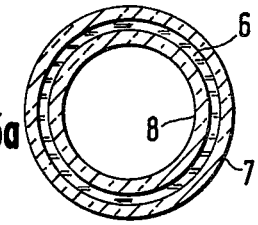
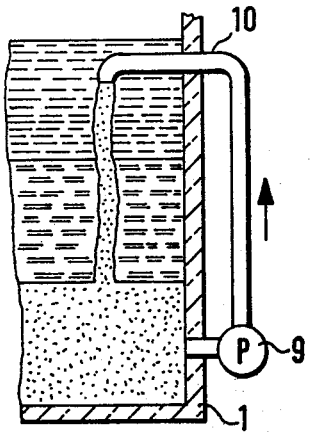
FIG.6
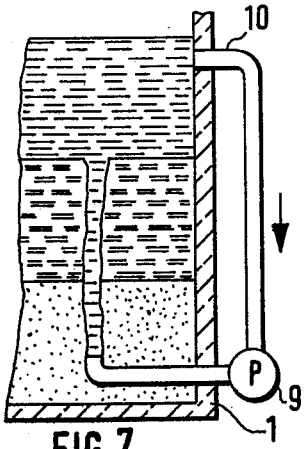
FIG.7
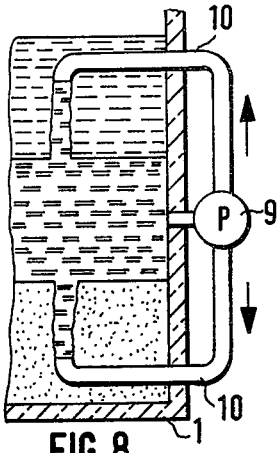
FIG.8

FIG.13
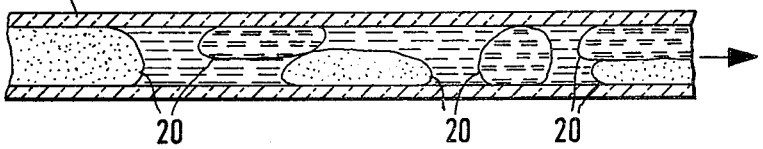
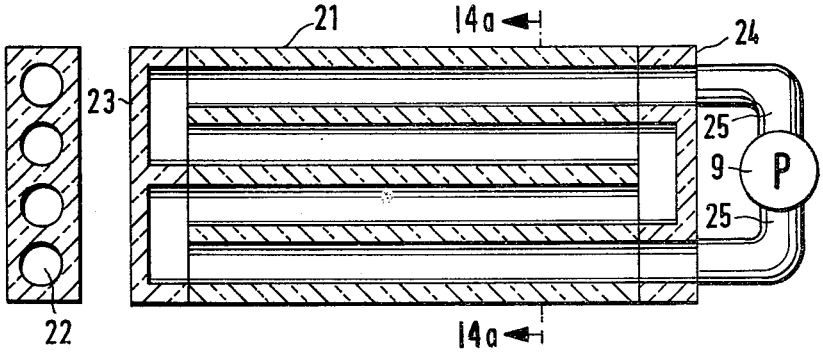
FIG.14a
FIG.14
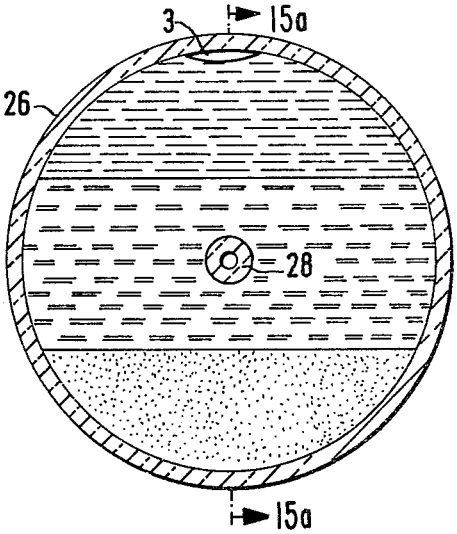
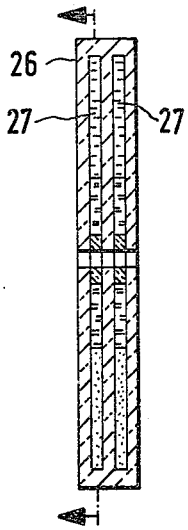
FIG.15
FIG.15a

DEVICE FOR PRODUCING AESTHETIC EFFECTS

The German Patent Specification No. 2,051,190 describes a rotary colour filter disc in the case of which a cavity is defined by two plates arranged with a small spacing between them and in the cavity two mutually non-miscible liquids are contained, of which at least one is coloured. As liquids water and liquid paraffin are mentioned. If the disc is caused to rotate, a kaleidoscopic effect is produced by the constantly changing constellations of the two liquids and this effect is projected by means of a lamp and an objective onto a wall or screen.

One aim of the present invention is to provide a device for the production of aesthetic effects, more especially light effects, for which more than two, that is to say three to five not completely and permanently mutually miscible liquids are defined and, on the other hand, make possible particular forms of the device with different and enhanced aesthetic effects.

The invention consists in a device for producing aesthetic effects, more particularly light effects, with at least one partly transparent or transluscent and preferably closed vessel, which comprises at least two liquids of different density which are not completely and not permanently miscible with each other, characterised in that in the order of increasing density at least three liquids A, B, C with the following principal or sole components are employed:

A liquid paraffin and/or silicone oil and/or naphthene and/or hexachlorobutadiene;

B water or an ether, more particularly propanetrioxyethylether or a polyether;

C esters with chemically bound phosphorus and/or chemically bound halogen, preferably chlorine, an ester of phthalic acid, and more particularly dibutoxybutyl phthalate, a carbonic acid ester, more particularly propanediol carbonate, 10 or ethanediolmonophenylether or tetrahydrothiophene-1,1-dioxide with the provision that the selected liquids are completely and not permanently miscible with each other.

The order A, B, C given in the preceding paragraph for increasing density does not apply if hexachlorobutadiene is used either alone or mixed with only small quantities of the other liquids, the sequence then being B, C, A.

The term "liquid paraffin" is to be understood to mean only mineral oils and benzines or only those consisting predominantly of alkanes, with preferably the following characteristics:

evaporation number in accordance with DIN 53170: above 500 viscosity (20° C): below 50 cP aromatics content: below 2% naphthene content: below 25% pour point: below 0° C.

The term "silicone oil" is to be taken to mean all silicone oils, which do not comprise any polar groups and are not fluorinated, that is to say those with or without phenyl groups with preferably the following characteristics:

evaporation number in accordance with DIN 53170: above 500 viscosity (20° C): below 100 cP pour point: below 0° C.

For "naphthenes" the above provided definition for liquid paraffin applies leaving out the naphthene content in the case of which however in its place the alkane content is less than 30%.

A convenient selection for the three liquids is specified in the subordinate columns 2–7 and the following table, which comprises dashes for impossible combinations, or combinations which are not to be recommended, instead of indicating a liquid.

| | 1 liquid paraffin | 2 silicone oil without phenyl groups | 3 silicone oil with phenyl groups | 4 naphthenes | 5 hexachlorobutadiene |
|---|---|---|---|---|---|
| 1 ethanediol-monophenyl-ether | water | water | water | — | — |
| 2 propane diol carbonate | water | water | water | water | water |
| 3 tri-(2-chloroethyl)-orthophosphate | water | water | water | water | water |
| 4 tetrahydrothiophen-1,1-dioxide | "Ambiflo L-317"* | "Ambiflo L-317"* | "Ambiflo L-317"* | — | — |
| 5 dibutoxyethyl phthalate | propanetrioxyethylether | propanetrioxyethylether | — | — | — |

*a polyether sold by The Dow Chemical company.

Amongst the combinations with three liquids those of the first column are preferred, in the case of which one liquid is therefore liquid paraffin and in this case as well the combinations of the second and third lines. Furthermore, the anhydrous combinations of the two last columns offer advantages because in this case freezing is unlikely.

Combinations with four liquids which are not completely and not permanently miscible with each other can be produced in accordance with a further development of the invention is as a fourth liquid a fluorinated silicone oil or a perfluoropolyether is employed. In both cases the characteristics given for silicone oil above apply for these two liquids.

If combinations of five liquids which are not completely and not permanently miscible with each other are to be used in accordance with a further development of the invention, additionally a fluorinated silicone oil and a perfluoropolyether are employed.

The perfluoropolyethers then constitute the respectively densest liquid E, while the fluorinated silicone oils represent the liquid D or also C.

Generally it is advantageous for the combinations of liquids in accordance with the invention if the density differences between the individual liquids are as large as possible. Thus, if the liquids are temporarily thoroughly mixed or emulsified in order to obtain certain effects, the destruction of the emulsion or the separation of the mixture of liquids is favoured by substantial differences in density. In particular cases however it is also possible that a slow breakdown of the emulsion or separation of the mixture is desirable so that in this case small density differences may be appropriate.

In accordance with a further development of the invention there is the provision that at least one of the liquids comprises solid or liquid additives in a dissolved form. In accordance with the particular type of the materials it is possible to attain different effects. Thus, an increase and possibly also a reduction in the density differences between the liquids can be ensured. For example by dissolving salts in water it is possible to achieve an increase in density. Other materials accelerate the separation of the liquids from each other after previous mixing or emulsification. For example in the case of the combination of liquids in accordance with line 2 of the above table it is possible to add to the propanediol carbonate approximately 4% of an active substance sold under the trade name of "Reofos 95" (Ciba). Other materials make possible a reduction in the freezing point or, respectively, the pour point of a liquid, for example salts in water.

Another effect which can be obtained by additives is the modification of the wetting properties of at least one of the liquids with respect to the vessel walls. If, for example, the three liquids in accordance with column 1, line 3 of the table are placed in a glass vessel which is then vigorously shaken, it will be observed after separation of the mixture that the glass surface in the water layer is covered with ugly droplets of the other liquids. If, however, approximately 40% of the tri-(2-chloroethyl)-orthophosphate is replaced by propanediol carbonate, that is to say if propanediol carbonate is mixed in, such droplets are not produced by shaking.

Other materials can lead to a reduction or attenuation of signs of decomposition or ageing of the liquids or materials in them. Thus, for example, conventional UV absorbing materials can improve resistance to light.

Another possibility is that of forming one of the liquids as a vehicle liquid with a colloidal suspension of magnetic particles so that a so-called "magnet liquid" is produced, which for example forms the center liquid in a combination of three liquids in one vessel.

In accordance with a significant further development of the invention at least one of the liquids is coloured. In addition to other light effects, more particularly coloration leads to particularly decorative aesthetic effects in the case of a device of the invention. In this respect the best effects are produced if in combinations of three to five liquids two or preferably three are coloured. The coloration can be ensured by dissolved dyes or coloured salts, for example for the combination of three liquids in accordance with line 2 of the table as follows:

A: yellow coloration by Sudan orange R of Messrs. BASF AG

B: coloured red-brown by manganese-(II)-glycerophosphate

C: coloured green by remacryl green 3B of Messrs. Hoechst AG (In C a part of the Sudan orange R is also dissolved.)

The other possibility is that of producing coloration by fine solid particles which are suspended, float or are deposited in the liquid, such as pigments, microcapsules, which for their part can comprise coloured liquids, lamellar structures, as for example of plastics, in the case of which all these particles have their largest dimensions below 1 mm. To give an example the pearl lustre pigment "Iriodin Ti 100" of Messrs. Merck AG can be used for coloration of the dibutoxyethyl phthalate in a liquid combination in accordance with column 5 of the table.

Particular effects can be obtained if at least one of the liquids comprises fluorescent or phosphorescent added matter. In this respect the liquid can be uncoloured or can be slightly coloured in addition. For example, it is possible to use an optical brightner, as for example "Ultraphor BP" of Messrs. BASF in the propanetrioxyethylether of a liquid combination in accordance with line 5 of the table. If this liquid is then irradiated with so-called "black light", that is to say a light which comprises a high proportion of ultraviolet, the liquid appears in a bright white form.

A particular form of effect can be achieved if, in accordance with a further development of the invention at least one, and preferably all liquids comprise an agent producing cloudiness. In the case of non-turbid liquids the best colour effect is generally obtained in transmitted light. In the case of cloudy or turbid liquids a different colouring effect occurs, that is to say if the light rays originating from the light source are dispersed in the liquid: For example, the tri-(2-chloroethyl)-orthophosphate in accordance with line 3 of the table appears cloudy if as a second liquid use is made of an approximately 20% aqueous solution of calcium chloride hexahydrate and after all three liquids have been temporarily emulsified with each other by shaking.

In accordance with a further development of the invention movable bodies are provided in the vessel adjacent to the liquids. In this respect, more particularly the specific weight of the bodies with respect to the density of the liquids can be so selected that the bodies drift around in the liquids and/or assume a position at the boundary layers between the liquids or, respectively, at the surface of the upper liquid or at the bottom in the lowermost liquid. The bodies should preferably have a geometrically regular, preferably spherical shape and can either consist throughout of the same material, for example of pigmented, naturally coloured or superficially dyed plastics material or can also consist of foamed material as an alternative. It is however furthermore possible to employ bodies in the form of closed hollow bodies, in which gaseous and/or liquid materials, for example also the liquids in accordance with the table are located. Fluorescent or phosphorent effects are also possible. Finally, the bodies can consist of magnetic material so that they can be moved magnetically.

As a vessel for containing the liquids it is possible to use all single-piece or multi-piece vessels suitable for permanently containing the liquids and which are at least partly transparent or transluscent. Preferably the vessels should be closed on all sides in order to prevent the liquids running out or being subject to losses by evaporation. The vessels can be closed for example by adhesive joints, welding, fusing etc.

The shape and construction of the vessels and their material and their production has a substantial effect on the aesthetic effects produced with the device in accordance with the invention since there are interactions between the selected liquid combination, for example its colour combination and the selected construction of the vessel, for example as regards its wall colour.

As materials for the vessels it is possible to use transparent and transluscent, possibly coloured, fluorescent or phosphorescent materials. In addition to glass and plexiglass it is possible to use also polystyrene, transparent polyarylsulfone, polyamide and thermoplastic polyester and polymethylpentene and also fluorinated ethylene and propylene polymers. Combinations of these materials with each other and with other transparent or transluscent materials, as for example metals, plastics etc. are possible.

The vessels can be partly or completely filled with the liquids. It is however possible to leave a small gas cushion, preferably air, in the sealed or closed vessel in order to avoid the vessel being caused to explode by the effect of thermal expansion.

Even with simple vessels, for example filled hollow cylinders and hollow columns of square cross-section of glass it is possible to obtain valuable aesthetic effects without means for producing movement or other electrical, magnetic, dynamic or thermal effects being called for.

For example such vessels can be used as ornaments on pieces of furniture, paper-weights etc. If the vessel is moved with the hand or if it is rapidly turned upside down, the liquids and possibly also the bodies contained in them return after swirling flow movements back into their original position. A construction in the form of artificial jewelry is also possible if the dimensions are suitably chosen.

Special effects can be obtained if in accordance with the invention the vessel comprises walls which are arranged with a close spacing to each other. In thin layers particular kaleidoscopic effects are obtained by the liquids slowly flowing into each other. In this case the walls arranged with a small spacing between them can be curved jointly, for example to form a coaxial double cylinder.

In accordance with a further possibility in accordance with the invention the vessel used can be in the form of a closed tube. The cross-sectional form is in this respect not critical but however it is preferable to use circular cross-sections. The tube does not have to be rigid and can also be in the form of a flexible tube. If the tube is joined at the ends it is possible to produce geometrically regular figures, more particular circular rings. Such rings can be provided, just as is the case with other vessel shapes, with means for hanging them on something or on top of something or with means for hanging them around something and in the case of a suitable choice of dimensions can also be used as artificial jewelry, for example as an arm ring or ear ring.

For obtaining additional effects it is possible to combine several vessels, for example in tandem so that the coloration effects are superimposed and additive. This is specially also applicable for vessels, in which the liquids are arranged in the form of thin layers.

A further development of the invention is characterized by a device for producing a continuous or discontinuous movement of the vessel. In this manner it is possible to obtain particular effects because the different liquids form continuously or discontinuously changing flow patterns with different shapes and colours. An additional effect is possible by changing the speed of movement and direction of movement of the vessel.

As a specific form of a moved vessel the invention provides a circular disc, which has a cavity or an annular cavity arranged concentrically with respect to the center of the circle for containing the liquids, in the case of which the circular disc is preferably adapted to rotate about its center point and is provided with drive means. In this respect the circular disc can have one or more further cavities or annular cavities, which are offset, preferably in a parallel manner, with respect to the first cavity or hollow cavity in the direction of the axis of the circular disc and, more particularly, are filled with liquid combinations with different colour. Since additionally the wall spacings can be varied, a wide scope is provided for obtaining different kaleidoscope-like flowing patterns with a great aesthetic attraction.

A further development of the invention provides that several vessels, more particularly in the form of shallow dish are arranged alongside one another on a rotary disc with a horizontal axis. In this case as well the individual vessels can again be filled with different liquid combinations and can possibly additionally comprise various moving bodies.

A further, important development of the invention is characterized by a pump for producing a movement of at least one of the liquids. In contrast to the above-mentioned embodiments in this case the vessel itself can be stationary. The term pumps in this respect is to be understood to mean all devices for producing liquid movement, for example mechanical pumps and pumps making use of thermal or magnetic effects. For the liquid movements produced by means of the pump or several pumps there are a number of possibilities. Thus, in accordance with one feature of the invention the pump is to draw in at least one of the liquids and transport it towards at least one of the other liquids. The transported liquid then drops through at least one other liquid layer or rises up to its original position. In the case of the use of three liquids it is possible, using the pump, to transport the uppermost liquid to the lowermost one or to transport the lowermost liquid to the uppermost one. It is also possible to pump the center liquid to the uppermost one and/or to the lowermost liquid layer. Additionally combinations of these different embodiments are possible.

In accordance with a further development of the invention several vessels are connected together using two openings preferably provided at the top and the bottom and connecting elements so as to form a closed pump circuit. For example in this manner several cylindrical vessels can be connected one behind the other or in tandem and in accordance with the type of the liquids, the type of the connections and the respective connection points certain layer formations of the individual liquids become established, which in certain cases can be arranged to move backwards and forwards between the individual vessels or to migrate.

Furthermore, in accordance with a further embodiment of the invention one pump arrangement is arranged to pump each of the liquids separately in the form of a fountain. In this respect it is possible to produce a multi-coloured fountain in the case of which the individual jets can emerge through nozzles of any desired cross-section. The cross-sections of the various nozzles can be different.

Particular decorative effects can be obtained in accordance with a further development of the invention in which a pump arrangement pumps a liquid separately or jointly to a vertical position above the uppermost liquid. The liquid or liquids can then return like a shower producing multi-coloured rain or can flow back over inclined surfaces with the formation of a preferably three-coloured waterfall. The surfaces can be additionally profiled or comprise flow guiding means.

Liquid structures differing from the flow effects so far described and having changing characteristics can be obtained in accordance with a further development of the invention by providing the vessel with a slim hollow body arranged horizontally or in a slightly inclined fashion and which with a pump forms a closed circuit. The flow speed in the hollow body is then set so that the liquids on the one hand do not emulsify and on the other hand do not form any separate layers. Then within the hollow body liquid bubbles are formed with different sizes and shapes which are arranged alongside each other or in tandem and can have the shape of drops or strands. At positions where by chance two different liquid elements are arranged, new colours can be produced by addition.

Preferably the hollow body is a tubular strand which returns into itself, for example in the form of a coil or meandering formation with a vertical axis. By varying the tube diameter changes in the flow speed can be obtained. In accordance with one particular embodiment in one body substantially parallel passages are arranged, which form the hollow bodies. The passages can be constructed for example in a plate, in the wall of a hollow cylinder or also in a hollow column of square cross-section.

In the case of all the above-described vessels for producing additional effects the inner and outer surface of the vessel can be reliefed or profiled in the vessel or also provided with flow guide surfaces.

Finally, a further development of the invention is characterized in that the device is provided with a light source. In this respect numerous different embodiments are possible. This applies both as regards the intensity and also the colour temperature and arrangement of the light source. The illumination does not have to be continuous and intermittent light sources, possibly with a stroboscopic effect can be employed.

LIST OF SEVERAL VIEWS OF DRAWINGS

The invention will be described in more detail with reference to the accompanying drawings.

FIGS. 1 to 5 show different vessel forms in several views each with a filling made up of three liquids in accordance with the invention.

FIG. 4*a* is a sectional view taken at 4*a*—4*a* of FIG. 4.

FIG. 5*a* is a sectional view taken at 5*a*—5*a* of FIG. 5.

FIGS. 6, 7 and 8 show diagrammatically a part of a vessel filled with three liquids, in the case of which a pump pumps respectively one of the liquids to one other liquid or the two other liquids.

FIGS. 9*a*, 9*b* and 10 show close pump circuits respectively with three vessels, which are respectively filled with three different liquids.

FIG. 13 shows diagrammatically part of a tube through which using a pump discrete drops or bubbles of different liquids are conveyed.

FIG. 14 shows a plate-shaped body with tubular passages, in which a flow movement in accordance with FIG. 13 can be produced using a pump.

FIG. 14*a* is a sectional view taken at 14*a*–14*a* of FIG. 14.

Figure 16:
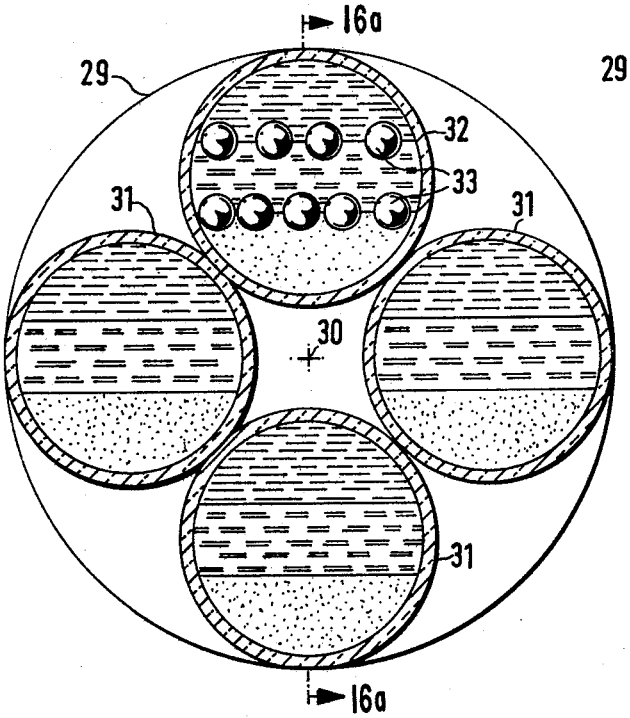

FIGS. 15 and 16 show rotary discs which comprise several vessels in different arrangements, the vessels being respectively filled with three liquids.

Figure 16A:
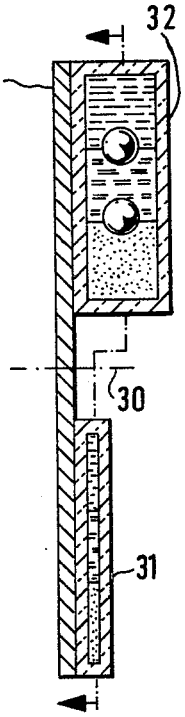

FIG. 15*a* is a sectional view taken at 15*a*—15*a* of FIG. 15. FIG. 16*a* is a sectional view taken at 16*a*—16*a* of FIG. 16.

DESCRIPTION OF PREFERRED EMBODIMENTS

FIG. 1 shows a vessel 1 in section, which can either be a circular cylinder or a hollow column with a rectangular or square cross-section. The vessel 1 is filled with three liquids of different density which cannot be completely and permanently mixed with each other, that is to say the liquids A, B and C. The representation used in FIG. 1 for the three liquids is used for the whole description. The specifically lightest, that is to say uppermost liquid A is indicated by short horizontal lines. For the center liquid B short horizontal double lines are used and the lowest liquid C is symbolised by small dots. As regards the above-described possibilities for the selection and additional effects on the individual liquids no further details are provided here. Generally the liquids are differently coloured. The same applies for the vessels used, which are generally made transparent.

In the case of the embodiment in accordance with FIG. 2 the vessel 1 comprises, in addition to the three liquids A, B and C floats in the form of small balls 2 whose specific weight is so selected that some are located at the bottom of the vessel 1 some, are located at the boundary layer between the liquids B and C, some are located at the boundary layer between the liquids A and B and some float on the liquid A. Above the liquid A a cavity or space filled with air is provided, while in the case of the embodiment in accordance with FIG. 1 and other embodiments, a small air bubble is left in the vessel, which avoids explosion or bursting of the vessel owing to thermal expansion of the liquids. The embodiment in accordance with FIG. 2 also produces a special effect if none of the three liquids is coloured. The balls 2 then appear to drift around in the vessel if suitable illumination is provided. On the other hand, however, it is also possible to use coloured liquids and additionally coloured balls.

FIG. 3 shows as a further embodiment of the invention a circular ring which is made up of a glass tube 4 with a circular cross-section and comprises three liquids. In FIGS. 4 and 4*a* a plate 5 is shown whose parallel walls only have a small spacing between them between 1 and 5 mm and thus form a narrow cavity 6, which only comprises a thin layer with the three liquids A, B and C. If the plate 5 is inclined out of the rest position, the liquids change their position with the formation of kaleidoscopic effects since they flow slowly into each other.

The embodiment of the invention in accordance with FIGS. 5 and 5*a* comprises a coaxial double cylinder 7, 8 which also defines a very narrow cavity 6. The embodiment of the invention in accordance with FIG. 5 can also be considered as having been produced by a curvature of the plate 5 of FIG. 4 in which case, forms different from those provided by the double cylinder 7, 8 can be produced. The embodiments of the invention in accordance with FIGS. 4 and 5 are produced of glass. It is however also possible to use transparent plastics materials joined together by adhesive.

FIGS. 6, 7 and 8 indicate how a pump 9 can convey one of the liquids to at least one of the other liquids. In FIG. 6 the liquid C is pumped or conveyed through a tube 10 to the liquid A and drops from this position in accordance with the setting of the pump in the form of a flexible tube or of drops through the liquid B to the bottom of the vessel 1. In the case of FIG. 7 on the other hand the pump 9 pumps the liquid A to the liquid C. From this position drops or a coherent jet then rise to the liquid A. In the case of the embodiment in accordance with FIG. 8 the liquid B is pumped both to the liquid A and also to the liquid C and then returns moving upwards and, respectively, downwards.

Figure 9A:
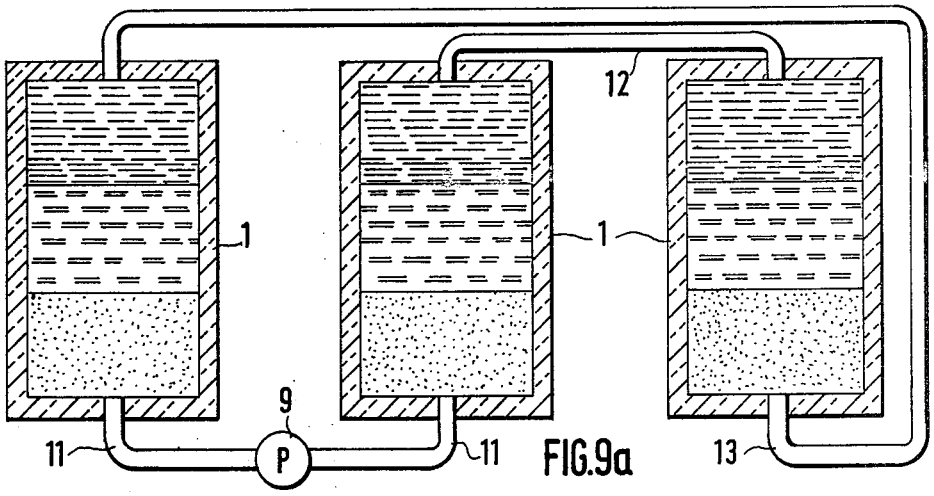
Figure 9B:
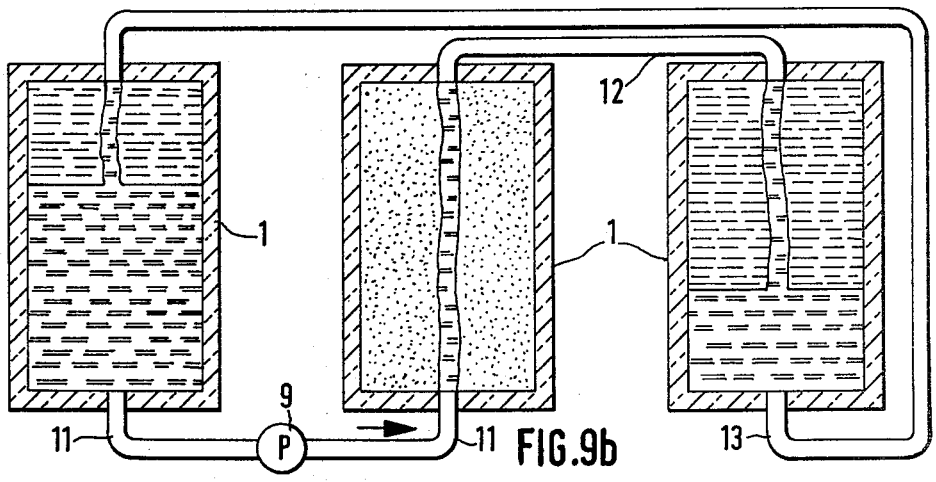

FIG. 9*a* shows a closed pump circuit which comprises three vessels 1, connecting tubes 11, 12, 13 and a pump 9 arranged along the tube 11. In the rest condition, that is to say before the pump 9 is put into operation all three vessels are respectively evenly filled with three liquids A, B and C, in the case of which the quantities and the layer heights are the same. If the pump 9 conveys or pumps in accordance with the arrow in FIG. 9*b*, the layer formation in accordance with FIG. 9*b* will eventually be produced instead of the layer formation in accordance with FIG. 9*a*. It can be seen that this result will be arrived at on considering that from the individual vessels 1 the same quantities flow out and the same quantitites flow into the vessels and that the overall quantity of the individual vessels cannot change. Instead of the result as shown in FIG. 9*b* independently of the speed of pumping it is also possible for other and changing formations to be produced, for example if large liquid quantities are entrained because insufficient time is available to assume the respective layer formation.

Figure 10:
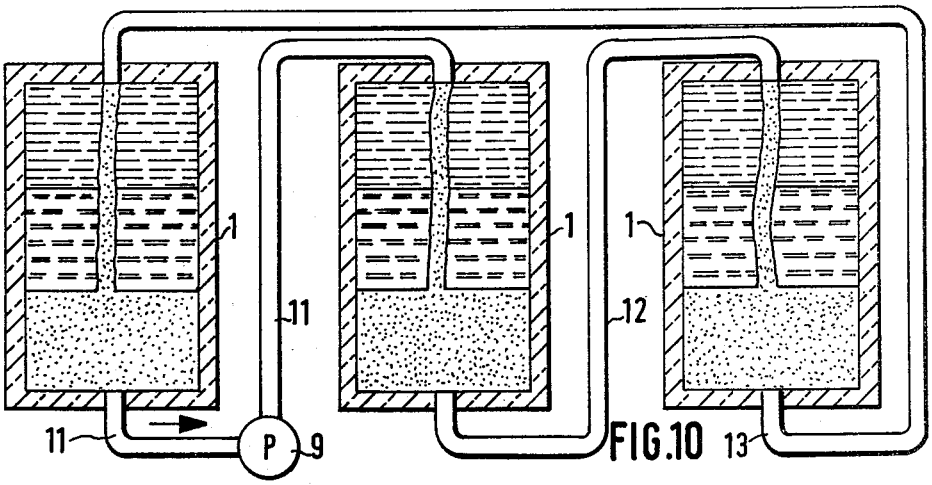

FIG. 10 shows a modification of the arrangement in FIG. 9 using different points of connection of the tubes 11 with the vessel 1 and a different layer formation is thereby produced.

Figure 11:
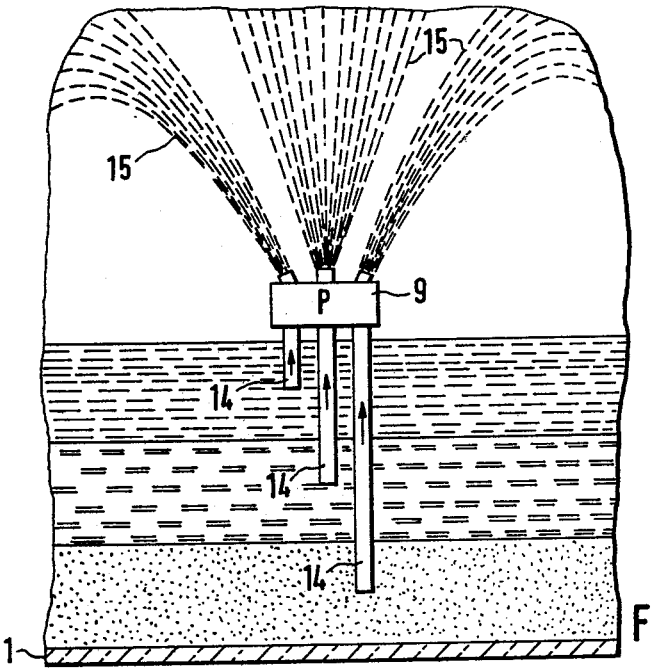
FIG. 11 shows a three coloured fountain produced with the help of a pump arrangement.
Figure 12:
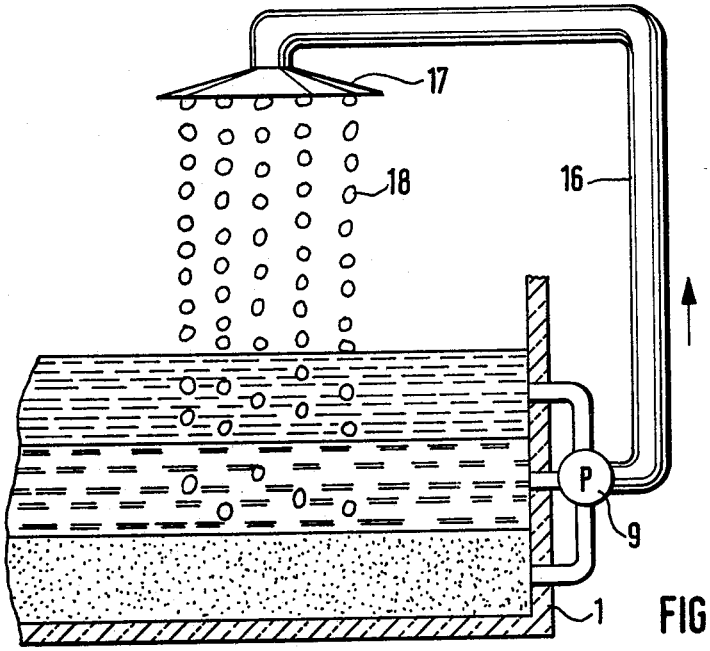
FIG. 12 shows a shower, supplied by a pump arrangement, which imitates multi-coloured rain.

FIG. 11 shows an embodiment of the invention in the case of which a pump arrangement 9 in conjunction with tubes 14 of different lengths pumps the three liquids A, B and C as separate multi-coloured jets 15 so as to resemble a three coloured fountain. The whole arrangement is enclosed for example in a closed vessel 1. The same applies also for the embodiment in accordance with FIG. 12, in the case of which a pump 9 pumps the three liquids jointly via a tube 16 to a shower head 17. Then all the liquid drops 18 fall like multicoloured rain back to the vessel 1.

In FIG. 13 a piece of tube 19 is shown diagrammatically, through which by means of a pump not shown three liquids are pumped with such a speed that separate bubbles or drops 20 are produced, that is to say on the one hand there is no emulsification owing to excessively high pumping speeds, and on the other hand there is no layer formation owing to an excessively low pumping speed. In this respect any emulsification which may occur just downstream from the pump does not have any impairing effect. It can easily be screened off by suitable means. The droplets or bubbles 20 can be most simply produced in the case of a horizontal or slightly inclined setting of the tube. In this respect the term tube is to be taken to mean hollow bodies which are long in proportion to their cross-section. Thus, the length of the hollow bodies should be at least 10 times the square root of the cross-sectional area. As cross-sectional areas values between 5 and 200 square millimeters are suitable. It is possible to use round, square or rectangular cross-sectional shapes.

In addition to a closed tube circuit in the form for example of a helix the flow patterns in accordance with FIG. 13 can also be achieved in an embodiment in accordance with FIG. 14. In this case a plate-shaped body 21 has tube-like passages 22, which together with attached end plates 23, 24, tubes 25 and a pump 9 form a closed circuit of meandering shape.

FIGS. 14 and 14*a* show a disc 26 produced using transparent material, which comprises two flat disc-like cavities 27, which are filled with three liquids in accordance with the invention. The disc 26 is pivotally mounted by means of a hub 28 and is driven by means of a device which is not shown. Along these lines it is possible to achieve a wealth of different colour effects, more particularly when there is a difference not only between the colours of the liquids in the individual cavities but also between the different cavities themselves. Instead of a single-piece disc with one or more shallow cavities 27 it is also possible to provide several discs with the same or different direction of rotation and speed of rotation. The spacing between the walls defined in the cavities 27 does not have to be the same. More particularly in the case of large-size discs a spacing can be advantageous which decreases in accordance with the distance from the axis of rotation.

FIGS. 16 and 16*a* show an embodiment of the invention in the case of which a rotary disc 29 is journalled on a horizontally placed shaft 30 so that it can be driven. On the rotary disc 29 there are four disc-shaped housings 31, 32, which each comprise three liquids in a disc-shaped cavity. In this respect the inner space of the vessel 32, shown uppermost in the figure, in contrast to the cavity of the vessel 31 is comparatively wide and additionally moving bodies in the form of balls 33 are provided, which in the resting position assume a location at the boundary surface between two respective liquids. If the rotary disc 29 is caused to rotate particularly attractive and different kaleidoscope flow patterns are produced continuously with changing shapes. As is the case with all other embodiments of the invention described above such a disc is very suitable for advertising or publicity purposes, as for example in a shop window.

I claim:

1. A device for producing visual aesthetic effects said device comprising a vessel with a wall which transmits light, said vessel containing at least two liquids of different density which are not completely and not permanently miscible with each other, and said device resulting from the bringing together in said vessel at least three liquids wherein said three liquids include at least one from each of the following three groups:

(a) liquid paraffin, silicone oil, naphthene, and hexachlorobutadiene;

(b) water, and an ether;

(c) an ester with chemically bound phosphorus, an ester with chemically bound halogen, an ester with chemically bound phosphorus and halogen, an ester of phthalic acid, a carbonic acid ester, ethanediolmonophenylether, and tetrahydrothiophene-1, 1-dioxide; wherein the said at least three selected liquids are not completely and not permanently miscible with each other.

2. A device in accordance with claim 1 wherein water and an ester with chemically bound phosphorus and chemically bound halogen are among said three liquids.

3. A device in accordance with claim 2 wherein said ester is an ester of orthophosphoric acid.

4. A device in accordance with claim 3 wherein said ester is tri-(2-chloroethyl)-orthophosphate.

5. A device in accordance with claim 1 wherein liquid paraffin, water, and ethanediolmonophenylether are said three liquids.

6. A device in accordance with claim 1 wherein water and propanediol carbonate all among said three liquids.

7. A device in accordance with claim 1 wherein a polyether and tetrahydrothiophen-1, 1-dioxide are among said three liquids.

8. A device in accordance with claim 1 wherein propanetrioxyethylether and dibutoxyethyl phthalate are among said three liquids.

9. A device in accordance with claim 1 and additionally comprising a perfluoropolyether.

10. A device in accordance with claim 1 and additionally coprising a fluorinated silicone oil.

11. A device in accordance with claim 1 and additionally comprising a fluorinated silicone oil and perfluoropolyether.

12. A device in accordance with claim 1 wherein at least one of said three liquids additionally comprises additives in a dissolved form.

13. A device in accordance with claim 1 wherein at least one of the liquids is colored.

14. A device in accordance with claim 1 wherein at least one of the liquids comprises fluorescent or phosphorescent additives.

15. A device in accordance with claim 1 wherein at least one liquid comprises an agent making it turbid.

16. A device in accordance with claim 1 and additionally comprising solid moving bodies.

17. A device in accordance with claim 16 wherein the density of said bodies in comparison with the density of the liquids is such that the bodies assume a position at the boundary of at least one liquid.

18. A device in accordance with claim 1 wherein said vessel has walls arranged at a small distance from each other.

19. A device in accordance with claim 18 wherein said walls form a coaxial double cylinder.

20. A device in accordance with claim 18 wherein the vessel is a sealed tube.

21. A device in accordance with claim 20 wherein said tube is invaginated and forms a geometrically regular figure.

22. A device in accordance with claim 18 and comprising several such vessels displaced from each other on a common horizontal axis.

23. A device in accordance with claim 1 and additionally comprising means for producing movement of the vessel.

24. A device in accordance with claim 23 wherein the vessel forms a circular disc provided with an annular cavity arranged concentrically with respect to the center point of said disc for holding said liquids and wherein said disc is arranged to be pivoted about said center point.

25. A device in accordance with claim 24 wherein said circular disc is provided with at least one additional liquid-holding cavity which is displaced axially from said first cavity and wherein said additional cavity is filled with a liquid combination different from the combination in said annular cavity.

26. A device in accordance with claim 1 and additionally comprising a pump for producing a movement of at least one of the liquids.

27. A device in accordance with claim 26 wherein said pump is adapted to draw in at least one of the liquids and transport it to at least one of the other liquids.

28. A device in accordance with claim 26 and additionally comprising several such vessels connected together in series with said pump to form a closed pump circuit.

29. A device in accordance with claim 59 wherein said pump is adapted to move said liquid to form a fountainlike spray.

30. A device in accordance with claim 26 wherein said liquid movement is to a point above the highest liquid.

31. A device in accordance with claim 26 wherein said vessel comprises a slim horizontal or slightly inclined liquid-containing hollow body which forms a closed circuit with said pump and wherein said pump is adapted to provide a liquid flow that on the one hand does not emulsify and on the other hand does not form any separate liquid layers.

32. A device in accordance with claim 31 wherein said hollow body is a tube which is tucked into itself.

33. A device in accordance with claim 31 wherein said hollow body is formed by at least two substantially parallel walls.

34. A device in accordance with claim 1 wherein the inner surfaces in the vessel are reliefed or profiled.

35. A device in accordance with claim 1 and additionally comprising a light source to illuminate said liquids.

36. A device in accordance with claim 1 wherein said halogen is chlorine.

37. A device in accordance with claim 1 wherein paraffin oil, water, and tri-(chloroethyl)-orthophosphate are said three liquids.

38. A device in accordance with claim 37 and additionally comprising a fluorinated silicone oil and a perfluoropolyether.

39. A device for producing visual aesthetic effects said device comprising a vessel with a wall which transmits light, said vessel containing at least three liquids of different density; which liquids when mixed, are adapted to separate into three liquid phases; and which liquids are selected to include at least one from each of the following three groups:

A. liquid paraffin, silicone oil, naphthene, and hexachlorobutadiene

B. water and an ether

C. an ester with chemically bound phosphorus, an ester with chemically bound halogen, an ester with chemically bound phosphorus and halogen, an ester of phthallic acid, a carbonic acid ester, ethanediolmonophenyl ether, and tetrahydrothiophene-1,1-dioxide.

* * * * *